US008006769B2

(12) United States Patent
Chambers, II et al.

(10) Patent No.: US 8,006,769 B2
(45) Date of Patent: Aug. 30, 2011

(54) SHEARING TOOL AND METHODS OF USE

(75) Inventors: James Edward Chambers, II, Magnolia, TX (US); Gerald Robert Byrd, Spring, TX (US)

(73) Assignee: Specialty Supply Companies, Cypress, TX (US)

( * ) Notice: Subject to any disclaimer, the term of this patent is extended or adjusted under 35 U.S.C. 154(b) by 72 days.

(21) Appl. No.: 12/378,383

(22) Filed: Feb. 13, 2009

(65) Prior Publication Data

US 2010/0206581 A1 Aug. 19, 2010

(51) Int. Cl.
*E21B 7/00* (2006.01)
*E21B 41/00* (2006.01)

(52) U.S. Cl. ..... 166/377; 166/243

(58) Field of Classification Search ..... 166/173, 166/170, 81.1; 15/88
See application file for complete search history.

(56) References Cited

U.S. PATENT DOCUMENTS

| | | | | |
|---|---|---|---|---|
| 2,682,068 | A * | 6/1954 | Harrigan | 15/88 |
| 4,681,160 | A | 7/1987 | Fineberg | |
| 5,348,091 | A | 9/1994 | Tchakarov et al. | |
| 5,600,862 | A * | 2/1997 | Bleske et al. | 15/104.04 |
| 6,082,451 | A * | 7/2000 | Giroux et al. | 166/72 |
| 6,885,308 | B2 | 4/2005 | Smith et al. | |

* cited by examiner

*Primary Examiner* — Kenneth Thompson
*Assistant Examiner* — James G Sayre
(74) *Attorney, Agent, or Firm* — The Matthews Firm

(57) ABSTRACT

A shearing tool for shearing, trimming, or reducing objects being pulled through a drill string and methods for retrieving retrievable tools with fins from the drill string, where the retrievable tools must pass through restrictions in the drill string having interior diameters less than the outer diameters of the fins. The fins, affixed to the retrievable tools, provide stability to the tools, while within the drill string, and can be made of rubber, plastic, other shearable materials, or combinations thereof. The apparatuses and methods include inserting a shearing tool with a flange into a box end of a section of drill string, where the flange keeps the shearing tool in place. The shearing tool further comprising a cutting surface for cutting materials pulled through the shearing tool.

13 Claims, 5 Drawing Sheets

SHEARING TOOL AND METHODS OF USE

FIELD OF THE INVENTION

The present invention relates generally to shearing tools and methods of shearing, trimming, or reducing materials on downhole tools for retrieving the downhole tools from within a drill string and to the surface.

BACKGROUND

Drilling, and especially directional drilling, employs a number of tools for determining the position of a drill bit and for directing the drilling force of the drill bit. These tools often reside within the drill string, near the drill bit, and either near or within a drill collar or near or within a sub in the bottom hole assembly. The tools require a secure fit within the drill string in order to ensure their stable operation. Blades or fins can be affixed to the exterior of such tools to centralize and stabilize these tools within the drill pipe of the drill string. In particular, fins made of materials, including rubber, hard plastics, other pliable or shearable materials, or combinations thereof, can be affixed to the tools to dampen the shock and vibrations common near the bottom assembly.

When these downhole tools stop functioning correctly, or when the drill string becomes stuck in the wellbore, the downhole tools must be retrieved and, frequently, are wire-lined out of the drill string and to the surface. During this retrieval of the downhole tools, the fins affixed to the tools, which assist in the operation and stability of the tools, can become obstacles in removing the tools from the drill string due to the need to pass these downhole tools with fins through restrictions in the drill string in order to retrieve the tools to the surface. Generally, the fins on the tools tend to extend towards an outer diameter of the drill string that is greater than that which could pass through various restrictions in the interior of the drill string.

Therefore, a need exists for a shearing apparatus that can reside in a drill string, or on the tool itself, for the purpose of shearing, trimming, and/or reducing objects, including materials such as fins on the body of the objects, with great stability and accuracy to allow the objects, such as downhole tools, to pass through restrictions in the drill string and, thus, be retrieved to the surface.

In addition, a need exists for methods of using a shearing apparatus to shear, trim, and/or reduce objects in a drill string, including materials such as fins on the body of the objects, with great stability and accuracy to allow the objects to pass through restrictions in the drill string and, thus, be retrieved to the surface. The apparatus and methods include securely fitting the downhole retrievable tools, including measuring-while-drilling tools, with fins and then shearing, trimming, and/or reducing the fins to retrieve the same tool through relatively small drill string restrictions and to the surface.

Further, a need exists for an apparatus and methods capable of shearing, trimming, and/or reducing multiple retrievable tools, as these downhole tools are removed from a drill string and retrieved to the surface.

The present embodiments meet these needs.

SUMMARY

The present invention relates generally to shearing tools and methods for retrieving downhole tools used within drill strings. The embodiments of the invention include shearing tools and methods for shearing, trimming, and/or reducing materials on downhole tools, such as stabilizing or centralizing fins located on the retrievable downhole tools, to enable the retrieval of the downhole tools through restrictions in the drill string and to the surface.

The shearing tool, for trimming objects being pulled through a drill string, can include a body, that is generally cylindrical comprising a channel. The body can include a first end, comprising a radially extending flange for securing the body in the drill string, a second end having a cutting surface, and an exterior. A plurality of spacers can be mounted on the exterior of the body for centralizing the body in the drill string, such that when objects are pulled through the channel of the body, the fins that are located on the objects can be sheared, trimmed, and/or reduced by the cutting surface located on the second end of the body, which can be inside the channel of the second end of the body, at the bottom of the second end of the body, or elsewhere on the second end. The fins can be made of a rubber, a plastic, other pliable or shearable materials, or combinations thereof, for ease of shearing, trimming, and/or reducing.

In an embodiment, the shearing tool for reducing the outer diameter of fins on objects being pulled through a drill string, can have a body having a first end, a second end, an interior channel, and an exterior surface. The shearing tool can be inserted into a drill string comprising a first section with a box end, a second section with a pin end, and a flow path therethrough. The first end of the shearing tool can engage the box end of the first section of the drill string, and the second end of the shearing tool can protrude into the flow path of the drill string for shearing materials, such as fins on retrievable downhole tools. The shearing of the materials on the tools occurs when the materials are pulled through the channel of the shearing tool, thereby coming in contact with the cutting surface of the shearing tool.

The embodiments of the invention include methods for removing a retrievable downhole tool comprising materials, such as centralizing or stabilizing fins, from a drill string. In an embodiment, the steps of a method for removing a retrievable tool with fins from a drill string include inserting the retrievable tool into a drill string, inserting a shearing tool into the drill string, shearing the fins on the retrievable tool with the shearing tool by pulling the retrievable tool through the shearing tool, and pulling the trimmed retrievable tool through a diameter reduction or restriction in the drill string and to the surface.

The next steps of the method can include providing the shearing tool with a flange, and inserting the shearing tool into a box end of a first section of the drill string so that the flange rests in the interior of the box end while a portion of the shearing tool protrudes into a flow path of the drill string.

In an embodiment, a method for removing a retrievable tool with fins from a drill string can include the steps of placing a retrievable tool with fins in a drill string and inserting a shearing tool into a box end of a first section of the drill string, above the retrievable tool and below any reduction or restriction in the interior diameter of the drill string. The steps of the method can continue by securing the shearing tool in the drill string, retrieving the retrievable tool, and shearing the fins of the retrievable tool during retrieval.

In another embodiment, the steps of the method for removing a retrievable tool with fins from a drill string can include providing the shearing tool with a flange for locking the shearing tool in place, between a first section of the drill string and a second section of the drill string, and providing the shearing tool with a cutting surface for shearing objects, such as the fins on a retrievable tool. In this embodiment, the steps of the method can include pulling the retrievable tool through the shearing tool for shearing, trimming, and/or reducing the fins on the retrievable tool so that the tool can be retrieved from the drill string and to the surface.

BRIEF DESCRIPTION OF THE DRAWINGS

In the detailed description of the embodiments presented below, reference is made to the accompanying drawings, in which.

Figure 1A:
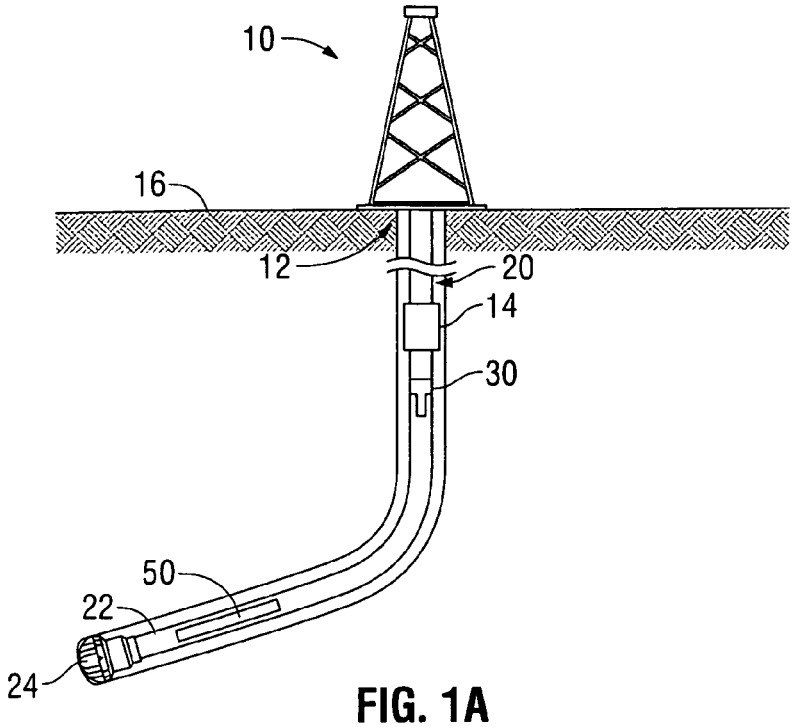
FIG. 1A depicts a side view of a drilling rig with a retrievable tool located downhole in accordance with an embodiment of the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION

Before explaining the present embodiments in detail, it is to be understood that the embodiments are not limited to the particular descriptions and that the embodiments can be practiced or carried out in various ways.

The present invention relates generally to shearing tools and methods for retrieving downhole tools used within drill strings, such as measuring-while-drilling (MWD) tools, steering tools, and EM pulse tools. More specifically, the present invention relates to shearing tools and methods for shearing, trimming, and/or reducing the stabilizing or centralizing fins that are located on retrievable tools, to enable the retrieval of the downhole tools through restrictions in the drill string and to the surface.

In an embodiment of the present invention, a shearing apparatus resides in the drill string for the purpose of shearing, trimming, and/or reducing materials from, or off of, the body of a downhole tool with great accuracy and stability, so that the body of the downhole tool can pass through restrictions in the drill string as tools are retrieved to the surface. For example, a measure-while-drilling (MWD) tool can be made to fit securely into a drilling string using fins, which are affixed to the MWD tool. If the MWD tool must be retrieved to the surface, a shearing apparatus can be placed in the drill string for shearing or trimming the fins on the tool, when the tool passes through the channel of the shearing apparatus, to allow the MWD tool to pass through relatively small drill string restrictions on its way to the surface.

In an example, MWD tools are placed in the drill string in order to provide a number of real-time downhole measurements. The MWD tools utilize gyroscopes, accelerometers, magnetometers and other instruments to determine the real-time position and direction of the drill bit. In addition to positional data, the MWD tools can provide measurements relating to the drilling bit and drilling conditions. For example, various MWD tools can measure rotational speed of the drill string, smoothness of that rotation, type and severity of any vibration downhole, downhole temperature, torque and weight on the drill bit that is measured near the drill bit, and mud flow volume. In order to accurately measure both the positional data and the drill bit data, the MWD tools must be located adjacent to the drill bit. Often the MWD tools reside in the drill collar near to the drill bit. This position, while desirable for sensing the variables in question, presents a harsh, hot, highly pressured, dirty and high shock-load environment for the MWD tools. Therefore, MWD tool failures are not uncommon in this environment, and require retrieval and replacement of the MWD tools located downhole. In addition, in the event that the drill pipe becomes stuck in the wellbore, the MWD tools may be permanently lost. Accordingly, the MWD tools must be retrieved from the drill string and to the surface, via such methods as wire-lining.

To improve the stability of the MWD tools while within the drill string, rubber fins have been used and affixed to the MWD tools to centralize and stabilize the MWD tool. These rubber fins are placed around the circumference of the retrievable MWD tools to increase their effective outer diameter and provide a secured fit within the drill string, which helps to cushion some of the shock effects inherent in the drilling processes. However, this method has not been ideal because the inner MWD tool components are designed to be retrieved through the drill string, and the tool's largest outer diameter must always be smaller than the smallest drill string restriction; otherwise, the MWD tool can not pass through the drill string restriction on its way to the surface. Accordingly, the rubber fins that have been used to centralize and stabilize retrievable MWD tools have required an initial sizing in order to pass through the smallest drill pipe restriction, which could and will be encountered. This sizing limitation has resulted in a less than snug and/or secure fit between the retrievable MWD tool and the surrounding MWD receptacle, which has hindered the effectiveness of the centralizer and stabilizer fins. Although the rubber centralizer and stabilizer fins have provided some benefit, the lack of a firmly fixed and secure fit permits some amplification of the downhole shocks on the retrievable MWD tool.

Therefore, a shearing tool and methods for shearing, trimming, and/or reducing the fins affixed to the retrievable downhole tools, such as the MWD tools, provide the benefits of making available a downhole tool with fins, that can be firmly fitted and secured within the drill string, while enabling the retrieval of the same downhole tool to the surface, through relatively small drill string restrictions.

Another benefit of the invention includes provision of a shearing apparatus for shearing, trimming, and/or reducing multiple retrievable downhole tools as the tools are removed from the drill string and to the surface, should more than one retrievable tool require removal. Steering tools, for directing the drill bit in directional drilling, and EM pulse tools, for transmitting data to the surface, suffer from similar problems in balancing their stability with their retrievability. Like MWD tools, both the EM pulse tools and the steering tools must be secured within the drill string during their operation. Certain EM Pulse tools and steering tools employ rubber fins for stability. Therefore, it can be difficult to secure firmly all of these tools in the drill string as well as to retrieve all of the tools, when necessary. The embodiments of the present invention include a shearing apparatus and methods for shearing, trimming, and/or reducing the outer diameter of materials, such as stabilizing and centralizing fins which are used by downhole tools, including MWD tools, steering tools, and EM Pulse tools, to remove the downhole tools past any restrictions in the drill string and to the surface.

It should be appreciated that these examples of tools, which may benefit from embodiments of the present invention, and the spirit of the invention are not limited to these tools and the methods of use, as described herein.

Referring now to the figures, FIG. 1A depicts a drilling rig 10 for drilling and operating a borehole or wellbore 12 in a surface 16, such as the ground. A drill string 20, illustrated in the borehole 12, can include a drill collar 22 adjacent to a drill bit 24. FIG. 1 illustrates a retrievable downhole tool 50 located in the drill collar 22. The retrievable downhole tool 50, illustrated in FIG. 1, is a Measure-While-Drilling (MWD) tool, and serves as an illustrative example of one tool that can benefit from embodiments of the present invention. Steering tools, EM Pulse tools, and other downhole tools with centralizing and/or stabilizing fins attached, can be used with the embodiments of the present invention in the same manner as illustrated in FIG. 1, and they can be located in subs or positions in the drill string, other than in the drill collar 22. The centralizing or stabilizing fins can be made of such materials as rubber, plastic, other pliable or shearable materials, or combinations thereof. The drill string 20 can contain a jar 14 and a shearing tool 30. In FIG. 1, the shearing tool 30 is shown located between the drill collar 22 and the jar 14. It should be appreciated that the retrievable tool 50 can be located elsewhere, in which case the shearing tool 30 would be placed between the retrievable tool 50 and the jar 14, or other restriction within the drill string 20.

The jar 14 is a component found in the drill string 20 known to those in the art for helping to "jar" loose the drill string 20, if the drill string 20 were to become stuck. The outer diameter of the jar 14 is limited by the inner diameter of the casing, which lines the borehole 12.

The radial space required by these jars 14 often results in a reduced inner diameter of the drill string 20, due to the mechanical components required to handle the tremendous force generated to physically jar a drill string 20 loose in a borehole 12, coupled with the limitations on the jar's 14 outer diameter. This restriction in the drill string 20 has previously reduced the effectiveness and use of rubber fins on retrievable tools 50. This is because, in order to be effective and to fit securely within the drill string 20, the outer diameter of the rubber fins affixed to the retrievable tool 50, would have to exceed the allowed space in the drill string 20 for passage by the retrievable tool 50 through the restriction.

Therefore, because the restriction(s) in the drill string 20 limited the allowance of space for passage of the retrievable tool within the drill string 20, the use of such fins and the size of the fins on retrievable tools has been limited, causing fins to be used that do not enable the retrievable tool to fit securely and firmly within the drill string 20. The jar 14 illustrated in FIG. 1 represents a restriction in, or a reduction in, the inner diameter of the drill pipe 20. It should be appreciated that the embodiments of the present invention include methods for withdrawing retrievable tools 50 through various restrictions, and are not limited to withdrawing retrievable tools through jars 14, only.

The borehole 12 illustrates a directional borehole, which can be accomplished by means known to those of ordinary skill in the art. It should be appreciated that, while retrievable tools 50, and specifically MWD tools, are commonly placed near the drill collar 22 for directional drilling operations, the present embodiments can be used in instances when the borehole is not directional. The system disclosed herein also can be used when the retrievable tool 50 is located at some position in the drill string 20, other than in or near the drill collar 22. The invention simply requires the shearing tool 30 to be located between the retrievable tool 50 and any reductions or restrictions in the inner diameter of the drill string.

Figure 1B:
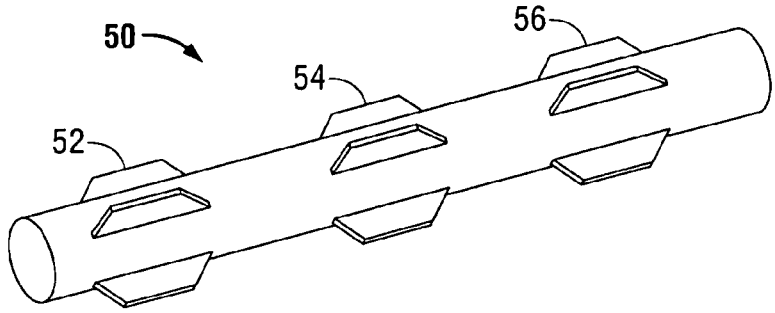
FIG. 1B depicts a perspective view of a retrievable tool comprising fins in accordance with an embodiment of the present invention.

FIG. 1B illustrates the exterior of a retrievable tool 50 in accordance with an embodiment of the present invention. The retrievable tool 50 comprises a first set of fins 52, a second set of fins 54, and a third set of fins 56, in this embodiment of the invention. The retrievable tool(s) 50 contemplated for use with embodiments of the present invention can range from a few feet to about 10 yards in length or more. The exact number of fins, and their location on the tool can vary and can be dictated by the nature of the tool and the total length of the tool. Therefore, a retrievable tool 50 can have fewer than three sets of fins, or more than three sets of fins, as required. Unlike prior art retrievable tools, the fins illustrated on the retrievable tool 50 are configured for a secure and firm fit of the tool within the drill string 20, near or in the drill collar 22 or another section of drill string 20. Appropriate sizing and configuration of the fins can ensure that the retrievable tool 50 is firmly secured within the drill string 20.

In one embodiment, the fins (52, 54, and 56) can be constructed from rubber, a hard plastic, other soft or pliable materials, or combinations thereof, in order to centralize the retrievable tool 50 and to stabilize the retrievable tool 50 within the drill string 20. Other materials are known in the art for centralizing the retrievable tools 50 in a drill string. Certain embodiments of the present invention prefer the use of materials that can be easily sliced or sheared off the retrievable tool 50, such as rubber or plastic.

Figure 1C:
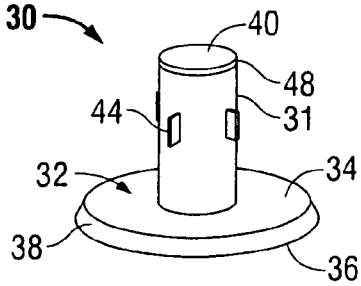
FIG. 1C depicts an elevational view of a shearing tool, usable in an embodiment of the present invention.

FIG. 1C depicts a shearing tool 30 usable with certain embodiments of the present invention. The shearing tool 30 comprises a cylindrical body 31 with a radially extending flange 32 at one end. It should be appreciated that the spirit of the invention is not limited to a cylindrical body 31. The body 31 of the shearing tool 30 need only have a shape and size able to reside in the drill string 20 (See FIG. 1). The radially extending flange 32 has a first surface 34 in its top and a second surface 36 on its bottom with an inward taper 38 between the two surfaces. This exact configuration is not required, and the spirit of the invention includes any extension from the body allowing the shearing tool to be secured within the drill string. An opening 40 passes through the center of the cylindrical body 31, and the radially extending flange 32. The end of the cylindrical body 31, opposite the radially extending flange 32, has an inward taper 46 (not shown in FIG. 1C) resulting in a cutting surface 48. Additionally, a plurality of spacers 44, attached to the cylindrical body, serve to keep the shearing tool 30 centralized in the drill string 20.

Figure 2A:
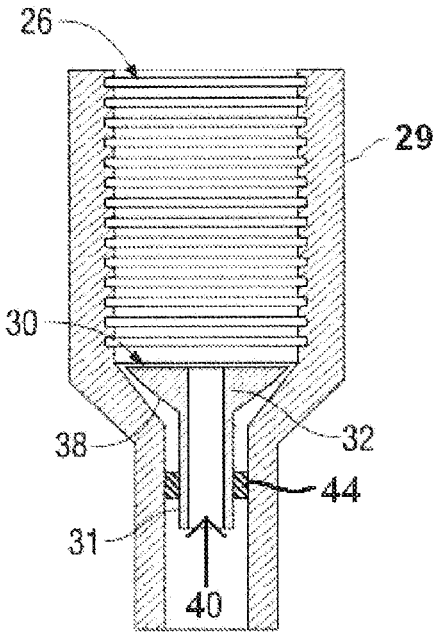
FIG. 2A depicts a cross-sectional view of a shearing tool, placed in the box end of a drill pipe, usable in an embodiment of the invention.

FIG. 2A depicts a shearing tool 30 inserted into the box end 26 of a first drill pipe section or a sub in a drill string. The cylindrical portion 31 of the shearing tool 30 is dimensioned to fit into the inner diameter of the fluid passage in the drill pipe 20, while the radially extending flange 32 is dimensioned to be larger than the inner diameter of the fluid passage and to rest in the bottom of the box end 26. The taper 38 of the flange 32 can be dimensioned to allow the shearing tool 30 to rest as far down in the box end 26 as is practical. The cylindrical portion 31 of the shearing tool 30 is shown having the opening 40 extending therethrough, to permit passage of a retrievable tool through the shearing tool. The spacers 44 are shown attached to the cylindrical portion 31 to centralize the shearing tool 30 within the drill string.

Figure 2B:
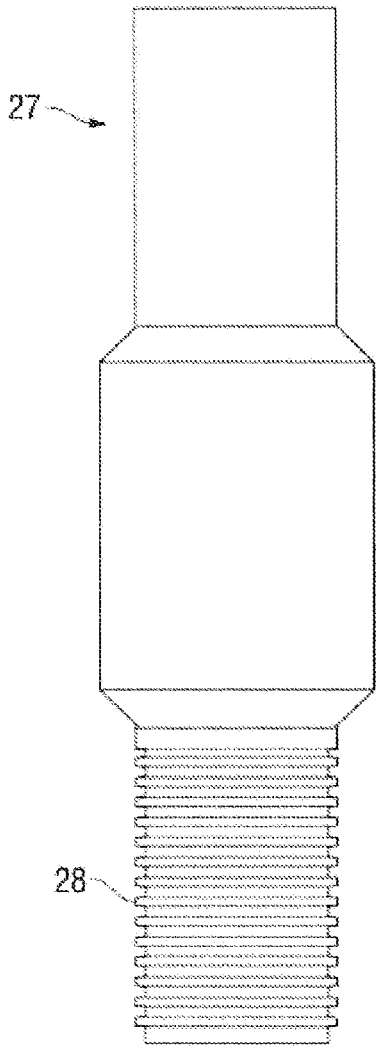
FIG. 2B depicts a cross-sectional view of a pin end of a second section of a drill pipe or sub, usable in an embodiment of the invention.

FIG. 2B depicts a pin end 28 of a second drill pipe section 27 or sub of a drill string 20, which can be stabbed and/or threaded into the box end 26 of a first drill pipe section or sub. The pin end 28 of the second drill pipe section 27 can be stabbed and threaded into the box end 26 (See FIG. 2A) of the first drill pipe section in any conventional manner. The thickness and the taper of the radially extending flange 32 (See FIG. 2A) can be dimensioned to maximize the threaded connection. In one embodiment, the threads of the pin end 28 can be engaged fully with the threads of the box end 26 (See FIG. 2A).

With regard to FIGS. 1A, 1C and 2A, once the first drill pipe section 24 and the second drill pipe section 27 are stabbed, the shearing tool 30 can be firmly locked into position. The second surface 36 on the bottom of the flange 32 of the shearing tool 30 can abut the bottom most surface of the second drill pipe section 27, which has been threaded into place. This contact prevents the shearing tool 30 from moving upwards. The first surface 34, on the top of the flange 32 of the shearing tool 30, as well as the taper 38 of the flange 32, abut the interior portion of the box end 26 of the first drill pipe section 24 and, through this contact, are prevented from moving downhole. In this way, the shearing tool 30 is firmly locked into place in the drill string 20.

Figure 3A:
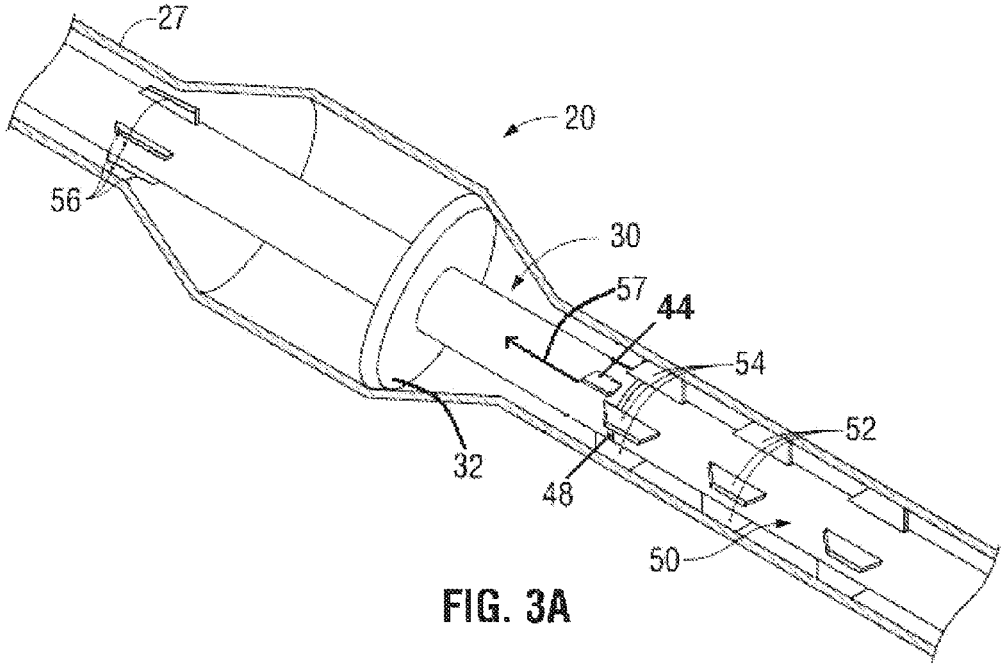
FIG. 3A depicts a perspective view of shearing tool, for shearing or trimming the fins of a retrievable downhole tool placed in a drill string, usable in an embodiment of the present invention.

FIG. 3A depicts the operation of the shearing tool 30 as the retrievable tool 50 is being wire-lined out of the drill string 20. The shearing tool 30 is shown placed at the connection between the first drill pipe section 29 (as shown in FIG. 2A), and the second drill pipe section 27, respectively. The threaded portions of the box and pin ends of each drill pipe section have been omitted from FIG. 3A for clarity, such that the placement of the shearing tool 30 within the drill string 20 is visible. However, it should be understood that the shearing tool 30 is secured against both upward and downhole movement through contact between the flange 32 of the shearing tool 30 and the box and pin ends of the adjacent drill pipe sections, in the manner described previously. The first set of fins 52 on the retrievable tool 50 can be seen to fit securely and firmly within the inner diameter of the drill string 20, as the retrievable tool 50 is being pulled toward the surface in the direction indicated by the arrow 57. The second set of fins 54 can be seen engaged with the cutting surface 48 of the shearing tool 30.

Figure 3B:
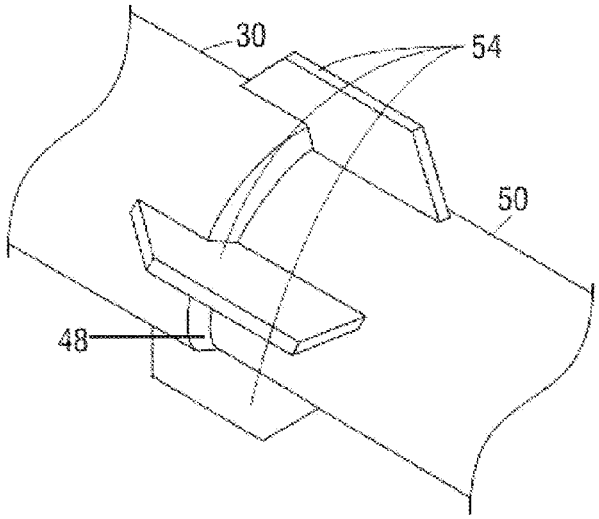
FIG. 3B depicts a perspective view of a retrievable tool comprising sheared or trimmed fins, in accordance with an embodiment of the present invention.

FIG. 3B provides a closer look at the second set of fins 54, having been sheared off the retrievable tool 50, as the retrievable tool 50 passes through the shearing tool 30.

FIG. 3A shows the third set of fins 56 having been sheared, already, as these fins protrude less and no longer contact the interior of the drill string 20. Once the entire length of the retrievable tool 50 has passed through the shearing tool 30 and each set of fins has been sheared, trimmed, or reduced, the retrievable tool will then be able to pass through any restrictions in the drill string on its way to the surface.

Figure 4:
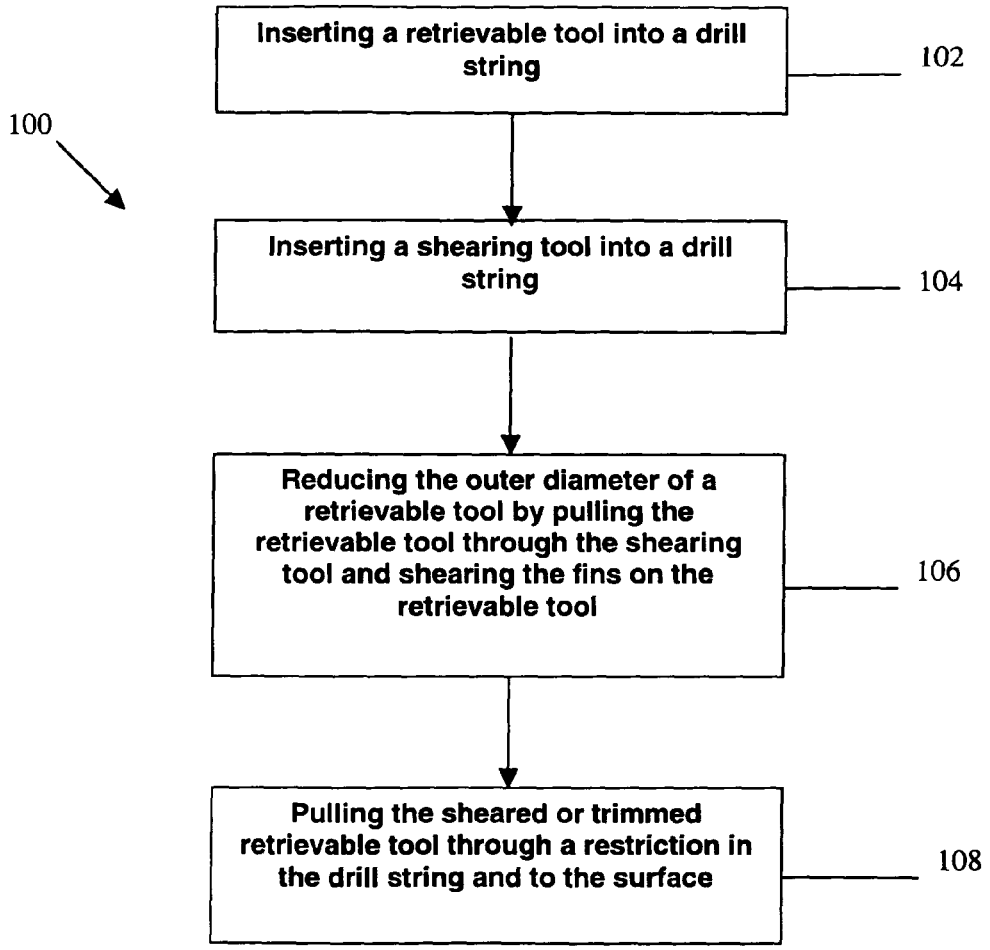
FIG. 4 depicts a flow chart of an embodiment of a method of using a shearing tool for removing a retrievable tool from a drill string.

FIG. 4 depicts a flow chart of a method 100, in accordance with an embodiment of the present invention. Step 102 includes inserting a retrievable tool into the drill string, and Step 104 includes inserting the shearing tool into the drill string. While many retrievable tools are near to, or inserted into, the drill collar of the drill string, the current method can include inserting the retrievable tool anywhere in a drill string. The shearing tool can be inserted above the retrievable tool in the drill string to ensure the retrievable tool passes through the shearing tool. The shearing tool can be located between the retrievable tool and any reductions or restrictions on the interior diameter of the drill pipe in order to reduce the diameter of the fins on the retrievable tool before the retrievable tool reaches any such reduction or restriction in diameter.

Step 106 of the method includes the shearing tool shearing, trimming, or reducing the outer diameter of the fins on the retrievable tool as the retrievable tool passes through the shearing tool, as described with respect to FIGS. 3A and 3B. This takes place at some point between the drill collar and some restriction in the interior diameter of the drill string. Step 108 of the method includes pulling the retrievable tool with sheared, reduced, and or trimmed fins, through any pipe restrictions in the drill string and to the surface.

Figure 5:
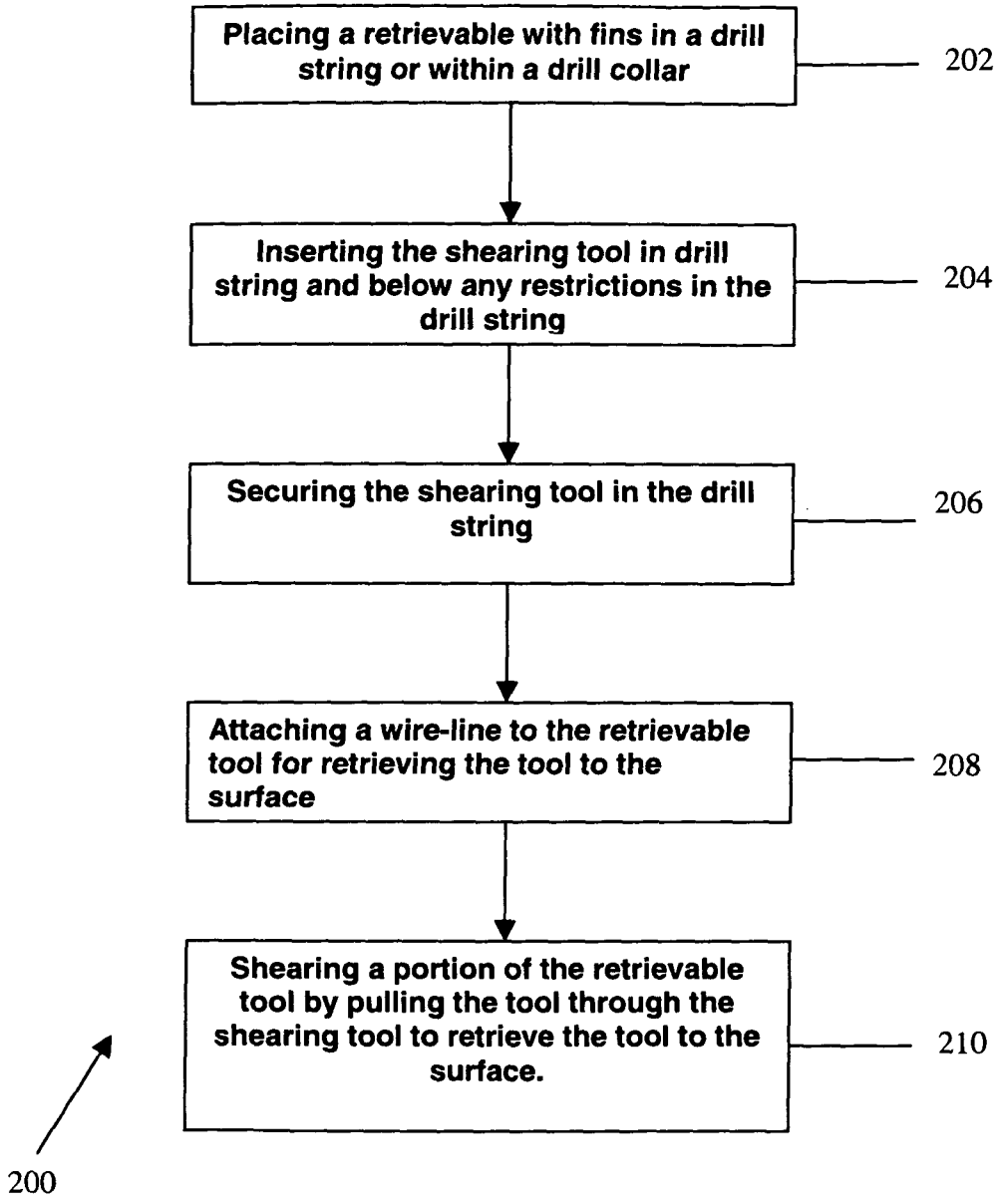
FIG. 5 depicts a flow chart of an embodiment of a method of using a shearing tool for retrieving a downhole tool comprising fins from a drill string.

FIG. 5 depicts a method according to an embodiment of the present invention. A method of removing a retrievable tool with fins is designated at 200. The steps of the method include placing the retrievable tool with stabilizing or centralizing fins in or near the drill string or in or near the drill collar of the drill string, Step 202. In one embodiment of the method, the retrievable tool can be placed in the drill collar at the surface and then the drill string is made up in the typical fashion as the drill bit and the drill collar are lowered into the wellbore.

The steps of the method can continue with inserting the shearing tool below any restrictions in the drill string, which can include placing the shearing tool in the box end of a first joint or sub of the drill string, Step 204. The insertable shearing tool can be placed in any section of drill pipe or sub, at an appropriately sized box end, but the shearing tool must be placed downhole of any jars or other reductions in the interior diameter of the drill string to ensure that the retrievable tool can pass through the shearing tool prior to any restrictions in the drill string in order to be retrieved from the drill string.

Step 206 of the method includes securing the shearing tool in the drill string, which can include stabbing the first section of drill pipe or a sub with a pin end of a second section of drill pipe or sub. In this way, the shearing tool can be firmly secured within the first section of drill pipe or sub and fixed in a position relative to the drill collar and drill bit, as the drill string continues to lower.

Step 208 includes the retrievable tool, such as a MWD tool or other downhole tool, being retrieved through the drill string, by attaching and using a wire-line. By tensioning the wire-line, the retrievable tool begins to work its way back up the drill string.

Step 210 includes the retrievable tool reaching the shearing tool and the shearing of the fins on the retrievable tool to allow the retrievable tool to move through the drilling string and to the surface. As the retrievable tool is pulled through the shearing tool, the fins are sheared, trimmed, and/or reduced by the cutting edge of the shearing tool, as previously described herein. Then, the reduced retrievable tool can pass easily through jars and other reductions in the drill string on its way to the surface.

The apparatus and methods of certain embodiments of the present invention generally operate by placing a retrievable tool 50 in the drill collar 22 of a drill string 20. Although, the retrievable tool can be placed elsewhere in the drill string, including but not limited to subs in the drill string 20, that are designed to accommodate retrievable tools 50. The retrievable tool 50 can comprise a plurality of fins as previously described for firmly centralizing the retrievable tool 50 in the drill collar 22 and for reducing the shock and vibration on the retrievable tool 50. As the drill string is lowered in the borehole 16, and sections of pipe are added to the drill string 20, the shearing tool 30 can be inserted in or at the box end 26 of a first section of drill pipe. The pin end 28 of a second joint of drill pipe or sub 27 is threaded into the box end 26 of the first section of drill pipe, locking the shearing tool 30 in place in the drill string 20. The shearing tool 30 can be inserted between any two joints or subs with the appropriate box and pin configurations. The only requirement regarding placement of the shearing tool is that the shearing tool is inserted before any jars 14 or other subs, with reduced interior diameters, so that the shearing tool 50 is downhole of any restriction or sub of the drill string 20.

Once the retrievable tool 50 and the shearing tool 30 are in place, drilling operations continue as they normally would until such time as it becomes desirable to retrieve the retrievable tool(s) 50. There can be several reasons for retrieving a retrievable tool 50. For example, the tool itself may not be functioning correctly, or the bit or the drill string 20 may be stuck. In order to remove the retrievable tool 50 through certain portions of the drill string 20, a wire-line is run through the drill string 20 and connected to the retrievable tool 50. The wire-line pulls the retrievable tool 50 to the surface 16.

The body of the retrievable tool 50 is generally constructed from a cylindrical metal tubing or a plurality of cylindrical metal tubings. The body's cylindrical shape will have a diameter less than the opening 40 in the shearing tool 30, so that the retrievable tool 50 will initially pass through the shearing tool 30 without impediment. However, when each set of fins reach the cutting surface 48 of the shearing tool 30, their outer diameter can extend or exceed the diameter of the opening 40 of the shearing tool 30. Since the shearing tool 30 is firmly locked in place, the wire-line can be tensioned to about 80-100 pounds or more so that the cutting surface 48 of the shearing tool 30 will begin to shear portions of the fins from the retrievable tool 50, as the retrievable tool 50 is pulled through the shearing tool 30, thereby reducing the outer diameter of the fins and, thus, the retrievable tool 50. Once each set of fins has passed through the shearing tool 30, the retrievable tool 50 will have a sufficiently small outer diameter to pass through any restrictions or reductions in the interior diameter of the drill pipe 20 on its way to the surface 16. After passing through the shearing tool 30, the retrievable tool can be wire-lined to the surface in the typical manner.

It will be understood that such terms as "up," "down," "vertical," "top," "bottom," and the like, are made with reference to the drawings and/or the earth and that the devices may not be arranged in such positions at all times depending on variations in operation, transportation, and the like. As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size of the components may be greatly different from that shown.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention. While the embodiments of the invention have been described with emphasis on the embodiments, it should be understood that within the scope of the appended claims, the embodiments might be practiced other than as specifically described herein.

The invention claimed is:

1. A shearing tool for trimming objects being pulled through a drill string having an interior with at least one restriction having an inner diameter comprising:

a body having a channel, wherein the body comprises a first end, a second end, and an exterior, wherein the body comprises an inner diameter which is less than the inner diameter of any restrictions in the interior of the drill string, and wherein the first end comprises a radially extending flange for securing the body in the drill string;

a plurality of spacers mounted on the exterior of the body for centralizing the body in the drill string; and a cutting surface on the second end of the body, wherein objects pulled through the channel are trimmed by the cutting surface.

2. The shearing tool of claim 1, wherein the shearing tool is inserted in a drill string for shearing fins on a retrievable tool while the retrievable tool is retrieved or pulled through the channel of the shearing tool, wherein the fins are made of materials selected from the group consisting of rubber, plastic, pliable materials, other shearable materials, and combinations thereof.

3. The shearing tool of claim 1, wherein the body is generally cylindrical in shape.

4. The shearing tool of claim 1, wherein the radially extending flange is tapered to fit in a box end of a section of the drill string.

5. The shearing tool of claim 4, wherein the shearing tool is substantially locked into position by a pin end of a second section of the drill string, wherein the second section is threaded into the box end of a first section of the drill string.

6. The shearing tool of claim 1, wherein a taper of the outer surface of the body at the second end creates a sharp surface for shearing fins extending from tools being pulled through the channel.

7. A method of removing a retrievable tool with fins from a drill string, wherein the method comprises the steps of:

inserting a retrievable tool into a drill string, wherein the retrievable tool comprises a downhole tool comprising a member selected from the group consisting of: a meaure-while-testing tool, a steering tool, an EM pulse tool, other downhole tools, and combinations thereof;

inserting a shearing tool into the drill string;

shearing fins on the retrievable tool with the shearing tool by pulling the retrievable tool through the shearing tool with a force greater than or equal to eighty pounds; and pulling the sheared retrievable tool through a diameter reduction in the drill string to the surface.

8. The method of claim 7, further comprising the step of spacing a cutting portion of the shearing tool from the inner diameter of a sub in the drill string.

9. The method of claim 7, wherein the fins on the retrievable tool are made of materials selected from the group consisting of rubber, plastic, pliable materials, other shearable materials, and combinations thereof.

10. The method of claim 7, wherein the step of inserting a shearing tool in the drill string further comprises the steps of:

providing the shearing tool with a flange; and inserting the shearing tool into a box end of a first section in the drill string so the flange rests in the interior of the box end while a portion of the shearing tool protrudes into a flow path of the drill string.

11. The method of claim 10, wherein the step of inserting a shearing tool in the drill string further comprises threading a pin end of a second section of drill string into the box end of the first section of drill string.

12. A method of removing a retrievable tool with fins from a drill string comprising the steps of:

placing a retrievable tool with fins in a drill string;

inserting a shearing tool into a box end of a first section of the drill string above the retrievable tool and below any reduction in the interior diameter of the drill string;

securing the shearing tool in the drill string;

retrieving the retrievable tool; and shearing the fins of the retrievable tool during retrieval by providing the shearing tool with a flange for locking the shearing tool in place between a first section of the drill string and a second section of the drill string, providing the shearing tool with a cutting surface for shearing objects pulled through the shearing tool, and pulling the retrievable tool through the shearing tool.

13. A shearing tool for trimming objects being pulled through a drill string comprising:

a body having a channel, wherein the body comprises a first end, a second end, and an exterior, wherein the first end comprises a radially extending flange for securing the body in the drill string, and wherein the radially extending flange is tapered to fit in a box end of a section of the drill string;

a plurality of spacers mounted on the exterior of the body for centralizing the body in the drill string; and a cutting surface on the second end of the body, wherein objects pulled through the channel are trimmed by the cutting surface.

* * * * *